US006581609B2

(12) United States Patent
Ott

(10) Patent No.: US 6,581,609 B2
(45) Date of Patent: Jun. 24, 2003

(54) METHOD FOR PRODUCING A HAIR STRIP

(75) Inventor: Gerhard Ott, Graz (AT)

(73) Assignee: BEGE Privatstiftung, Vienna (AT)

( * ) Notice: Subject to any disclaimer, the term of this patent is extended or adjusted under 35 U.S.C. 154(b) by 0 days.

(21) Appl. No.: 09/885,438

(22) Filed: Jun. 20, 2001

(65) Prior Publication Data

US 2002/0014249 A1 Feb. 7, 2002

(30) Foreign Application Priority Data

Jun. 20, 2000 (AT) ..... 1062/00

(51) Int. Cl.[7] ..... A41G 5/00; A41G 3/00
(52) U.S. Cl. ..... 132/201; 132/53
(58) Field of Search ..... 132/53, 201, 54, 132/55, 56, 200

(56) References Cited

U.S. PATENT DOCUMENTS

| | | | | |
|---|---|---|---|---|
| 3,424,175 A | * | 1/1969 | Hartwich | 132/53 |
| 3,530,862 A | * | 9/1970 | Hudson | 132/201 |
| 5,072,745 A | * | 12/1991 | Cheh | 132/201 |
| 5,413,124 A | * | 5/1995 | Incando | 132/201 |
| 5,868,145 A | | 2/1999 | Spann | 132/201 |
| 6,000,406 A | | 12/1999 | Loren | 132/200 |

FOREIGN PATENT DOCUMENTS

| | | | |
|---|---|---|---|
| DE | 94 11 835 | 7/1994 | A41G/5/00 |
| FR | 1 301 935 | 7/1962 | |
| GB | 1 351 733 A | 5/1974 | A41G/3/00 |

OTHER PUBLICATIONS

Townsend, Self adhesive hair extension, Nov. 1, 2001, US2001/0035192A1.*

Ra, Attachable Hair Extension, Nov. 8, 2001, US 2001/0037813A1.*

* cited by examiner

*Primary Examiner*—John J. Wilson
*Assistant Examiner*—Robyn Kieu Doan
(74) *Attorney, Agent, or Firm*—Baker Botts LLP

(57) ABSTRACT

Method for producing a hair strip wherein hairs lying adjacent to one another are joined together striplike by fusing on and cooling of a strip of synthetic material. For secure cementing of the hairs these are joined together at a predetermined distance from one of their two ends by pouring on of a strip of synthetic material, following which the protruding ends are cut off after solidification of the synthetic material. For improving the hold of the hairs, they may be joined in the region of the strip of synthetic material either before or after this has been poured on by additionally stitching with a thread preferably consisting of the same material.

8 Claims, 1 Drawing Sheet

METHOD FOR PRODUCING A HAIR STRIP

CROSS-REFERENCE TO RELATED APPLICATION

This application claims priority to Austrian Patent Application Ser. No. A1062/2000, filed on Jun. 20, 2000, which is hereby incorporated by reference in its entirety herein.

BACKGROUND OF THE INVENTION

The invention relates to a method for producing a hair strip, wherein hairs lying adjacent to one another are joined together striplike by fusing on and cooling of a thermoplastic synthetic material.

A method of this kind has been disclosed in DE 94 11 835 U1. According to this source, the strip or strips of synthetic material is/are placed at one end of the hairs and cemented with them by heating and cooling. When used in application to a human head for the purpose of lengthening or thickening of the hair of the head, individual tufts are separated from the hair strips finished in this manner, and attached to a suitable spot on the hair of the head by fusing on and cooling of the synthetic material.

It has been found in practice that the individual hairs in hair strips so finished have a variable hold, i.e., that embedding in and cementing with the synthetic material is not equally effective for all hairs. As a result, when substitute hair parts mounted on the hair of the head in this manner are combed, some substitute hairs become detached after a short time. To ensure better adhesion of the substitute hairs it has also already been proposed (DE 19 62 61 07 A1) that the substitute hair tufts may be attached by a small flat thermoplastic plate, which becomes flexible upon heating and therefore can be wrapped around the concerned hair group of the hair of the head and sealed.

Although this measure brought improvement, it was still unable to prevent the occasional combing out of substitute hairs.

The object of the invention is to improve the adhesion of substitute hairs in hair strips suitable for application to the hair of the head.

SUMMARY OF THE INVENTION

According to the invention, this object is accomplished by the method, described above, in that the hairs are joined together at a predetermined distance from one of their two ends by pouring on of a strip of synthetic material and cutting off the projecting ends after solidification of the synthetic material.

It has been found, according to the known methods of cementing of substitute hairs only at their ends, that satisfactory embedding of each individual hair in the synthetic material cannot be ensured. For this reason, according to the invention, the strip of synthetic material is placed at some distance (i.e., 1–2 cm) from the hair end, and specifically, not by laying on, fusing on and hardening, but by pouring on and hardening. In this way encasing and cementing on all sides of each individual hair is ensured. The protruding hair ends must then be cut off. The greater expenditure in this method, as compared with the prior art, is offset by the reliability of adhesion of the hairs.

For the added assurance of hold of the substitute hairs, it is advisable additionally to join the hairs in the region of the strip of synthetic material by stitching with a thread, either before or after it is poured on. The thread preferably consists of the same material. If the thread consists of the same thermoplastic material, there is the additional advantage that an even more intimate bond and fusion of the thread with the strip of synthetic material and the hairs take place when the substitute hair part is joined with the hair of the head by thermoplastic cementing.

Since it may be more favorable not to join the hair strip by thermoplastic cementing with the hair of the head when, for example, secure adhesion cannot be expected, fastening loops, tabs, eyelets or the like may be added to the strip of synthetic material after the protruding hair ends have been cut off. These loops or the like can be used to join the substitute hair part with the hair of the head in conventional fashion by stitching with a regular thread or a cementing thread.

BRIEF DESCRIPTION OF THE DRAWINGS

The method according to the invention is explained in detail below by means of an example illustrated in the drawings, wherein.

DETAILED DESCRIPTION OF THE INVENTION

Figure 1:
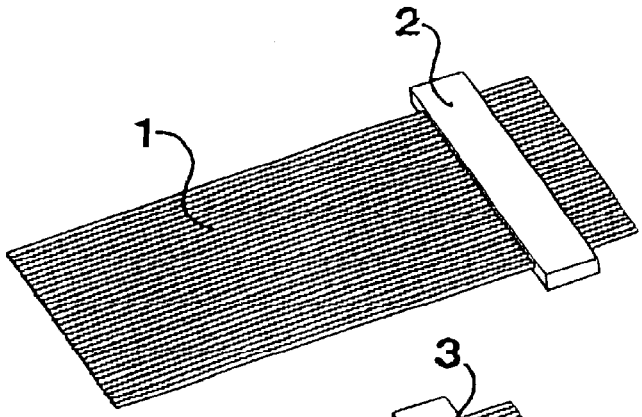
FIG. 1 shows a hair strip after the strip of synthetic material has been poured on in accordance with the invention.
Figure 2:
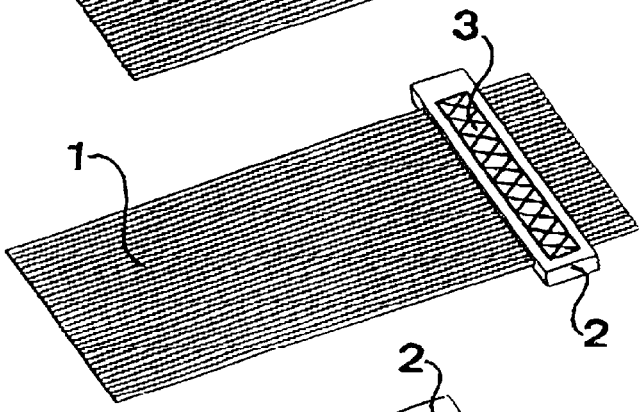
FIG. 2 shows this hair strip after stitching has been added in accordance with the invention.
Figure 3:
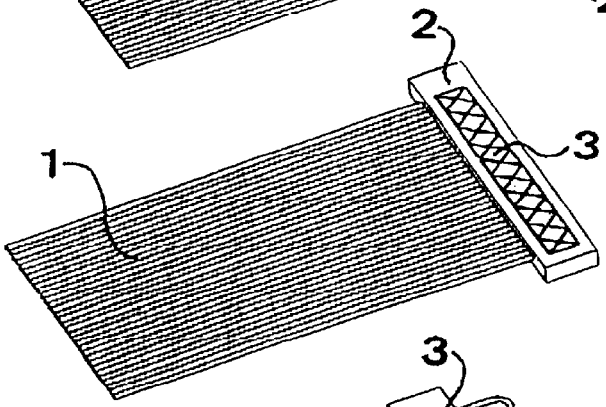
FIG. 3 shows the same hair strip after the protruding hair ends have been cut off in accordance with the invention.
Figure 4:
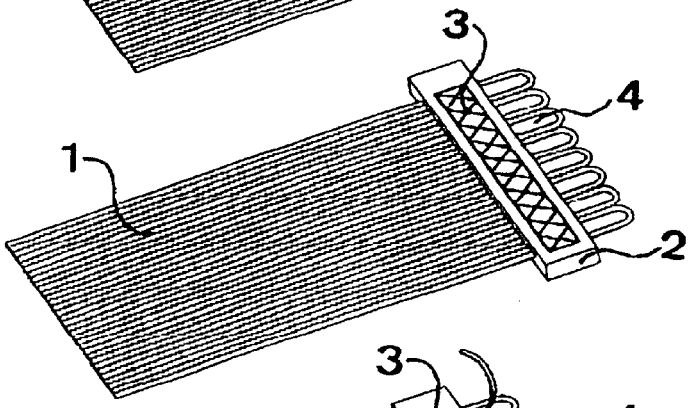
FIG. 4 shows the hair strip after attachment of fastening loops in accordance with the invention.
Figure 5:
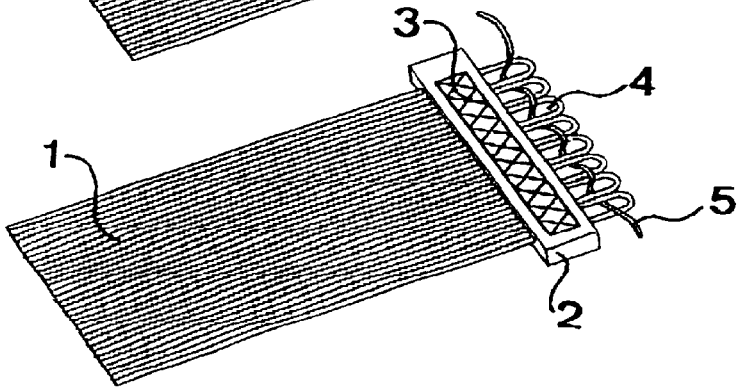
FIG. 5 schematically shows the stitching on of the hair strip of FIG. 4 in accordance with the invention.

For producing the hair strip in accordance with the invention, the hairs 1 are arranged parallel and embedded at some distance from one of their ends in a thermoplastic strip 2 of synthetic material by pouring (FIG. 1). After—or before—that, they may in addition be stitched with a thread 3, which may comprise, for example, the same thermoplastic material, for example (FIG. 2). After the protruding hair ends have been cut off (FIG. 3), the hair strip per se is ready for application by direct stitching or cementing. If desired, fastening loops 4 may in addition be mounted on the strip 2 of synthetic material (FIG. 4), with the aid of which stitching, for instance with a cementing thread 5 (See, for example, according to AT 405 710 B), with the hair of the head or additional substitute hair parts is possible.

I claim:

1. A method for producing a hair strip wherein hairs lying adjacent to one another are joined together striplike by fusing on and cooling of a thermoplastic synthetic material, comprising:

joining the hairs together at a predetermined distance from one of their two ends by pouring on of a strip of synthetic material; and cutting off the hairs protruding from an end of the strip after allowing solidification of the synthetic material.

2. The method according to claim 1, further comprising:

stitching the hairs in the region of the strip of synthetic material by a thread, before the step of joining the hairs together at a predetermined distance from one of their two ends by pouring on of a strip of synthetic material.

3. The method according to claim 2, further comprising providing the thread comprising the synthetic material.

4. The method according to claim 1, further comprising:

stitching the hairs in the region of the strip of synthetic material by a thread, after the step of joining the hairs together at a predetermined distance from one of their two ends by pouring on of a strip of synthetic material.

5. The method according to claim 4, further comprising providing the thread comprising the synthetic material.

6. The method according to claim 1, further comprising:

adding fastening loops to the strip of synthetic material, after the step of cutting off the hairs protruding from an end of the strip after allowing solidification of the synthetic material.

7. The method according to claim 1, further comprising:

adding tabs to the strip of synthetic material, after the step of cutting off the hairs protruding from an end of the strip after allowing solidification of the synthetic material.

8. The method according to claim 1, further comprising:

adding eyelets to the strip of synthetic material, after the step of cutting off the hairs protruding from an end of the strip after allowing solidification of the synthetic material.

* * * * *